US011326813B2

(12) United States Patent
Muller

(10) Patent No.: US 11,326,813 B2
(45) Date of Patent: May 10, 2022

(54) REFRIGERATION APPARATUS

(71) Applicant: Carrier Corporation, Palm Beach Gardens, FL (US)

(72) Inventor: Raphael Muller, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 31 days.

(21) Appl. No.: 15/930,670

(22) Filed: May 13, 2020

(65) Prior Publication Data

US 2020/0370800 A1 Nov. 26, 2020

(30) Foreign Application Priority Data

May 21, 2019 (EP) ..... 19175787

(51) Int. Cl.
*G01K 13/00* (2021.01)
*F25B 31/00* (2006.01)
*F25B 43/00* (2006.01)

(52) U.S. Cl.
CPC ..... *F25B 31/004* (2013.01); *F25B 43/006* (2013.01); *F25B 2500/16* (2013.01); *F25B 2500/26* (2013.01); *F25B 2700/03* (2013.01)

(58) Field of Classification Search
CPC ..... F25B 1/00; F25B 31/004; F25B 31/002; F25B 43/006; F25B 49/02; F25B 21/02;
(Continued)

(56) References Cited

U.S. PATENT DOCUMENTS 6,176,092 B1 * 1/2001 Butterworth ..... F04D 29/023 62/193
6,550,258 B1 * 4/2003 Shoulders ..... F04C 28/06 62/472

(Continued)

FOREIGN PATENT DOCUMENTS

| | | | |
|---|---|---|---|
| EP | 1400765 | A2 | 3/2004 |
| WO | 2015142825 | A1 | 9/2015 |
| WO | 2017024101 | A1 | 2/2017 |

OTHER PUBLICATIONS

European Search Report for application EP 19175787.1, dated Oct. 31, 2019, 6 pages.

*Primary Examiner* — Henry T Crenshaw
*Assistant Examiner* — Kamran Tavakoldavani
(74) *Attorney, Agent, or Firm* — Cantor Colburn LLP

(57) ABSTRACT

This refrigeration apparatus (1) includes a main refrigerant circuit (2) including a positive displacement compressor (4), a condenser (6), an expansion valve (8), and an evaporator (10), through which a refrigerant circulates successively in a closed loop circulation, and a lubrication refrigerant line (18) connected to the main refrigerant circuit (2) between the condenser (6) and the expansion valve (8) or to the condenser (6), in which circulates a portion of the refrigerant of the main refrigerant circuit (2) and connected to the compressor (4) for lubrication of said compressor (4) with the refrigerant. The refrigeration apparatus includes a lubrication refrigerant tank (20) connected to the lubrication refrigerant line (18) upstream the compressor (4), the lubrication tank (20) being configured to store liquid refrigerant for lubrication of the compressor (4) and the lubrication refrigerant tank (20) comprises means (32, 34; 38, 40) to cool down the refrigerant.

16 Claims, 4 Drawing Sheets

(58) Field of Classification Search
CPC ..... F25B 2400/121; F25B 2400/16; F25B 2500/16; F25B 2700/03; F25B 2700/04; F25B 2321/02; F25B 2321/025; F04C 29/02
USPC ..... 62/129
See application file for complete search history.

(56) References Cited

U.S. PATENT DOCUMENTS

| | | | | |
|---|---|---|---|---|
| 10,527,050 | B2 * | 1/2020 | Sishtla | F04B 39/02 |
| 2011/0197604 | A1 * | 8/2011 | Minor | C09K 5/045 62/117 |
| 2017/0097007 | A1 * | 4/2017 | Sishtla | F04D 17/08 |
| 2018/0209697 | A1 * | 7/2018 | Nishida | F25B 1/10 |

* cited by examiner

REFRIGERATION APPARATUS

FOREIGN PRIORITY

This application claims priority to European Patent Application No. 19175787.1, filed May 21, 2019, and all the benefits accruing therefrom under 35 U.S.C. § 119, the contents of which in its entirety are herein incorporated by reference.

BACKGROUND

The present invention concerns a refrigeration apparatus.

A refrigeration apparatus is known from EP 1 400 765, comprising a refrigerant circuit including a screw compressor, a condenser, an expansion valve and an evaporator. This known apparatus comprises a bypass flow passage, branching at a part of said refrigerant circuit between the condenser and the expansion valve, routing through throttle means, and communicating with a rotor cavity and with bearings of the screw compressor. Lubrication of the compressor is achieved by the same fluid that is also used as refrigerant in the circuit, and in the absence of oil.

For successfully lubricating the rotor cavity and the bearings at the start of the refrigeration apparatus after a standby period or at the first start, one must ensure that a sufficient amount of lubrication refrigerant is present in liquid state in the rotor cavity and in the bearings, to avoid potential damages of the compressor. In some cases, depending on the location of the compressor with respect to the other components of the main refrigerant circuit, the liquid refrigerant may not be available in sufficient quantity in the bypass flow passage to properly lubricate the compressor. After a period of standby, or before the first start of the refrigeration apparatus, the liquid refrigerant present in the lubrication line may not be in sufficient quantity to properly lubricate the compressor at the first start or restart, or might have migrated towards another part of the main circuit. For example, the liquid refrigerant may have migrated by gravity to a low part of the refrigerant circuit remote from the compressor.

SUMMARY

An aim of the invention is to provide a refrigeration apparatus where proper lubrication of the compressor by the refrigerant is guaranteed at the time of start of the refrigeration apparatus.

To this end, the invention concerns a refrigeration apparatus comprising: a main refrigerant circuit including a positive displacement compressor, a condenser, an expansion valve, and an evaporator, through which a refrigerant circulates successively in a closed loop circulation; a lubrication refrigerant line connected to the main refrigerant circuit between the condenser and the expansion valve or to the condenser, in which circulates a portion of the refrigerant of the main refrigerant circuit and connected to the compressor for lubrication of said compressor with the refrigerant.

According to the invention, the refrigeration apparatus comprises a lubrication refrigerant tank connected to the lubrication refrigerant line upstream the compressor, the lubrication tank being configured to store liquid refrigerant for lubrication of the compressor and the lubrication refrigerant tank comprises means to cool down the refrigerant stored in the lubrication refrigerant tank prior to a starting operation of the refrigeration apparatus.

Thanks to the invention, at the start of the refrigeration apparatus, the compression chamber and the bearings of the compressor are provided with a flow of liquid lubricant stored in the tank. In addition, the cooling of the refrigerant in the tank produces a cold point that forms the coldest part of the refrigerant circuit. Gaseous refrigerant present in the tank is condensed, inducing a depression that spontaneously attracts liquid and gaseous refrigerant towards the tank. The hazard of damage of the compressor due to an insufficient amount of refrigerant during start-up of the refrigeration apparatus that may be caused due to migration of the refrigerant to other parts of the refrigerant circuit is therefore avoided.

According to further aspects of the invention that are advantageous but not mandatory, such a refrigeration apparatus may incorporate one or several of the following features: The refrigerant tank is placed in a top area of the refrigeration apparatus, and feeds the compressor with lubrication refrigerant by gravity. The lubrication refrigerant tank comprises detection means of the level of liquid refrigerant in the lubrication refrigerant tank. The lubrication refrigerant line comprises a valve upstream the lubrication refrigerant tank and a valve downstream the lubrication refrigerant tank, and whereas these valves are closed during standby periods of the refrigeration apparatus and opened during a starting operation of the refrigeration apparatus. The valves are solenoid valves that are controlled by a control unit of the refrigeration apparatus. The refrigeration apparatus comprises at least one heating device mounted on the condenser, or on the evaporator, or both, and configured to heat up the refrigerant contained in the condenser and/or the evaporator to induce migration of liquid refrigerant towards the lubrication refrigerant tank. The heating device is an electrical heating belt. The means to cool down the refrigerant stored in the lubrication refrigerant tank are formed by at least one thermoelectric cooler provided on a shell of the lubrication refrigerant tank and configured to cool an inner volume of the lubrication refrigerant tank, and by at least one heat sink configured to reject heat generated by the thermoelectric cooler outside the lubrication refrigerant tank. The lubrication refrigerant tank comprises a plurality of thermoelectric coolers mounted in sandwich between at least one face of the lubrication refrigerant tank and the heat sink. The refrigeration apparatus comprises an electrical power supply unit configured to feed the at least one thermoelectric cooler with electrical current on a starting operation of the refrigeration apparatus. The means to cool down the refrigerant stored in the lubrication refrigerant tank comprise: a heat exchanger comprising a tube circulating within the lubrication refrigerant tank, the tube having a first end in which a pressurized gas is released, and a second end connected to atmospheric pressure; a removable container of pressurized gas connected to the first end of the tube, and configured to be opened toward the tube so that the pressurized gas is released to the atmosphere along the tube at a starting operation of the refrigeration apparatus. The tube has a serpentine-like shape. The first end of the tube comprises a valve that is opened at a starting operation of the refrigeration apparatus. The removable container contains a pressurized gas chosen amongst at least propane or carbon dioxide. The refrigeration apparatus operates an oil free refrigerant cycle. The means to cool down the refrigerant stored in the lubrication refrigerant tank comprise a magnetic cooling device.

DRAWING DESCRIPTION

Exemplary embodiments compliant to the invention and including further advantageous features of the invention are explained below, in referenced to the attached drawings, in which.

DETAILED DESCRIPTION

Figure 1:
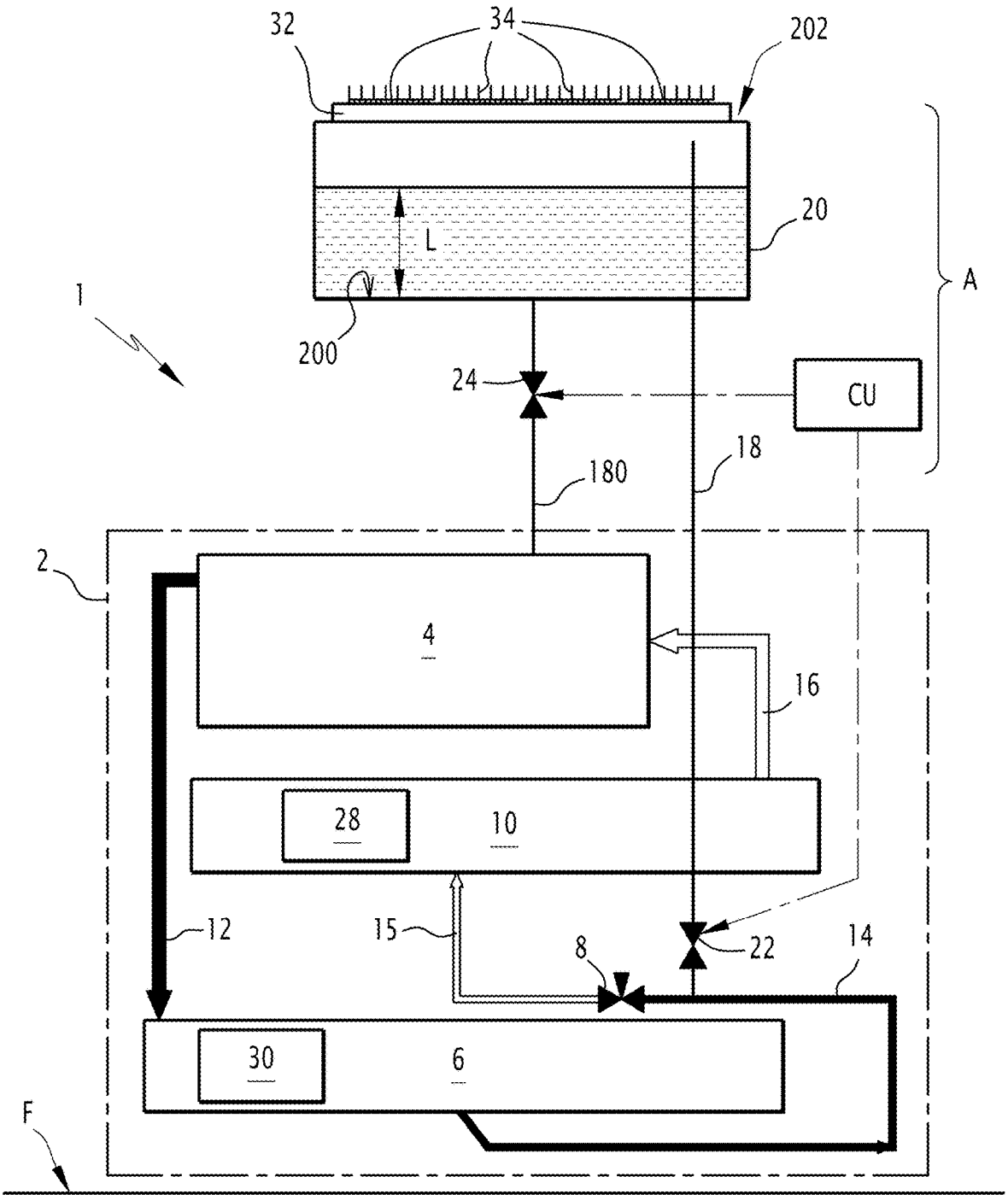
FIG. 1 is a synoptic drawing showing a refrigeration apparatus according to a first embodiment of the invention.

FIG. 1 represents a refrigeration apparatus 1, comprising a main refrigerant circuit 2 through which a refrigerant circulates in a closed loop circulation. The main refrigerant circuit 2 comprises four main components: a positive displacement compressor 4, also called volumetric compressor, a condenser 6, an expansion valve 8, and an evaporator 10. The refrigerant circulates successively in these four components according to a thermodynamic cycle.

Preferably, in a steady-state, during high load operation of the refrigeration apparatus 1: in the compressor 4, the refrigerant is in a gaseous state, and is compressed from a low pressure to a high pressure, which raises the temperature of the refrigerant from a low temperature to a high temperature; in a discharge line 12 connecting the compressor 4 to the condenser 6, the refrigerant is in a gaseous state, or essentially gaseous state, and is at the high temperature and the high pressure; in the condenser 6, the refrigerant is in a bi-phasic state, including gaseous and liquid refrigerant, and is condensed to a liquid state by the condenser 6; in a line 14 connecting the condenser 6 to the expansion valve 8, the refrigerant is in a liquid state, or essentially liquid state, is at the high pressure, and may be at the high temperature or at a temperature between the high temperature and the low temperature; in the expansion valve 8, the refrigerant is brought to the low pressure, which lowers the temperature of the refrigerant to the low temperature while evaporating the refrigerant to the bi-phasic state; in a line 15 connecting the expansion valve 8 to the evaporator 10, the refrigerant is in a biphasic-state, where a major part is liquid and a smaller part is gaseous, and the refrigerant is at the low temperature and the low pressure; in the evaporator 10, the refrigerant is in a bi-phasic state, including gaseous and liquid refrigerant, and is evaporated to a gaseous state by the evaporator 10 by absorbing heat from another medium, mainly water, which is cooled down when leaving the evaporator 10; in a suction line 16 connecting the evaporator 10 to the compressor 4, the refrigerant is in a gaseous state, or essentially gaseous state, at the low pressure and at a low temperature, or at a temperature between the low and the high temperature.

For example, the low temperature is approximately between 5-10° C., the high temperature is approximately between 35-40° C., the low pressure is approximately between 3-4 bar, and the high pressure is approximately between 6-10 bar.

Considering the above, the main circuit 2 comprises a high-pressure part, consisting in the discharge line 12, the condenser 6 and the line 14, and a low-pressure part, consisting in the line 15, the evaporator 10 and the suction line 16.

In a part of the main circuit 2, which covers only a portion of the high-pressure part, preferably consisting in the condenser 6 and the line 14, the refrigerant is mostly in liquid state and high pressure.

The positive-displacement compressor 4 may be chosen between at least a scroll compressor, a screw compressor, a piston compressor, a rotary compressor, or a Roots compressor. The compressor 4 comprises non-shown rotors and bearings.

To insure the proper operation of the compressor 4, it is essential that the rotors and the bearings are sufficiently lubricated with a liquid lubricant.

The refrigerant of the refrigeration apparatus 1 is a fluid material chosen to ensure both functions of refrigerant and lubricant. Preferably, the refrigerant used in the apparatus is a hydrofluoroolefin (HFO), for example R1234ze (1,3,3,3-tetrafluoroprop-1-ene). There is therefore no lubrication oil present in the main refrigerant circuit 2. The refrigeration apparatus 1 is operating an oil-free refrigerant cycle.

In the condenser 6 and between the condenser 6 and the expansion valve 8, where the refrigerant of the main circuit 2 it mostly in liquid state and at high pressure, is the part of the main circuit 2 where the refrigerant is in the most appropriate state to be used as lubricant.

The refrigeration apparatus 1 comprises a lubrication refrigerant line 18 connected between the condenser 6 and the expansion valve 8, and connected to the compressor 4 for lubrication of said compressor 4 with the liquid refrigerant. According to a non-shown embodiment, the lubrication refrigerant line 18 may be connected to the condenser 6, for example in a bottom area of the condenser 6.

To prevent a shortage of lubricant that may damage the compressor 4 at first start or restart, the refrigeration apparatus 1 comprises a lubrication refrigerant tank 20 connected to the lubrication refrigerant line 18 upstream the compressor 4. The lubrication tank 20 is configured to store liquid refrigerant for lubrication of the compressor 4. The lubricant tank 20 retains a given quantity of liquid refrigerant and is connected to the compressor 4 so that a sufficient quantity of refrigerant may be provided to the compressor 4 for lubrication purpose.

The lubrication refrigerant tank 20 comprises means to cool down the refrigerant stored in the lubrication refrigerant tank 20 prior to a starting operation of the refrigeration apparatus 1. This permits to insure that the refrigerant is duly in liquid state prior to being injected into the compressor 4, and creates a cold point to induce a phenomenon of spontaneous migration of the liquid refrigerant towards the tank 20. This cold point condenses any gaseous part of the refrigerant present in the tank 20, creating a depression that attracts gaseous and liquid refrigerant towards the tank 20. This phenomenon of spontaneous migration of the refrigerant makes it unnecessary to use a pump in the lubrication refrigerant line 18, as the circulation of liquid refrigerant towards the lubrication refrigerant tank 20 is self-induced. This avoids the use of costly parts and additional fluid lines, which may increase the cost of the refrigeration apparatus and lead to more failures due to additional moving parts. The means to cool down the refrigerant will be described in more detail below.

As shown on FIG. 1, the refrigerant tank 20 may be placed in a top area A of the refrigeration apparatus 1, and feed the compressor 4 with lubrication refrigerant by gravity. In such a case, the refrigerant tank 20 may be placed so that the compressor 4 is at a height below the height of the refrigerant tank 20 with respect to a floor F on which the refrigeration apparatus 1 is installed. The refrigerant tank 20 is connected to the compressor 4 by a section 180 of the lubrication refrigerant line 18. The section 180 is located under the refrigerant tank 20 and connects with a bottom 200 of the refrigerant tank 20.

In one embodiment, the lubrication refrigerant line 18 comprises a valve 22 upstream the tank 20 and a valve 24 downstream the tank 20. These valves 22 and 24 are closed during stand-by operations of the refrigeration apparatus 1. This allows that during standby, a minimal quantity of liquid refrigerant is kept in the tank 20. These valves 22 and 24 are opened before a starting operation of the refrigeration apparatus 1, so that the stored liquid refrigerant can flow towards the compressor 4 for lubrication, and that entry of new liquid refrigerant in the tank 20 due to the starting of the operation of the main circuit 2 is allowed.

The valves 22 and 24 may be solenoid valves controlled by a control unit CU of the refrigeration apparatus 1. The control unit CU may be configured to send control signals to the valves 22 and 24 depending on the state of operation of the refrigeration apparatus 1. The control unit CU may monitor the state of operation of the refrigeration apparatus 1 to detect stand-by periods of the refrigeration apparatus 1, starting commands by an operator, for example using the state of an ON/OFF command. The control unit CU may also detect a request for cooling or heating based on a temperature request for a water flow leaving the evaporator 10, compared to a measured temperature for the water leaving the evaporator 10.

The lubrication refrigerant tank 20 preferably comprises detection means 26 of the level L of liquid refrigerant in the lubrication refrigerant tank 20. The detection means 26 may comprise, for example optical sensors, for detecting a low level L1 of lubrication refrigerant, or a high level L2, requested to allow the compressor 4 to start. The level measures obtained by the detection means 26 may be transmitted to the control unit CU to allow or disallow starting of the compressor 4.

According to an optional embodiment, the refrigeration apparatus 1 may comprise at least one heating device mounted on the condenser 6, or on a shell of the evaporator 10, or both, and being configured to heat up the refrigerant contained in the condenser 6 and/or the evaporator 10 to induce migration of liquid refrigerant towards the lubrication refrigerant tank 20. For example, the refrigeration apparatus 1 may comprise a heating device formed by a heating belt 28 mounted on a non-shown shell of the evaporator 10, and a heating device formed by a heating belt 30 mounted on a non-shown shell of the condenser 6. The heating belts 28 and 30 may be electrical devices configured to be fed with electrical current before or during a start of the refrigeration device 1. The heating belts 28 and 30 generate heat so that the refrigerant in the shells of the evaporator 10 and the condenser 6 becomes hotter than the refrigerant present in the other places of the main circuit 2 and the lubrication refrigerant line 18, and migrates spontaneously towards the lubrication refrigerant tank 20.

Figure 2:
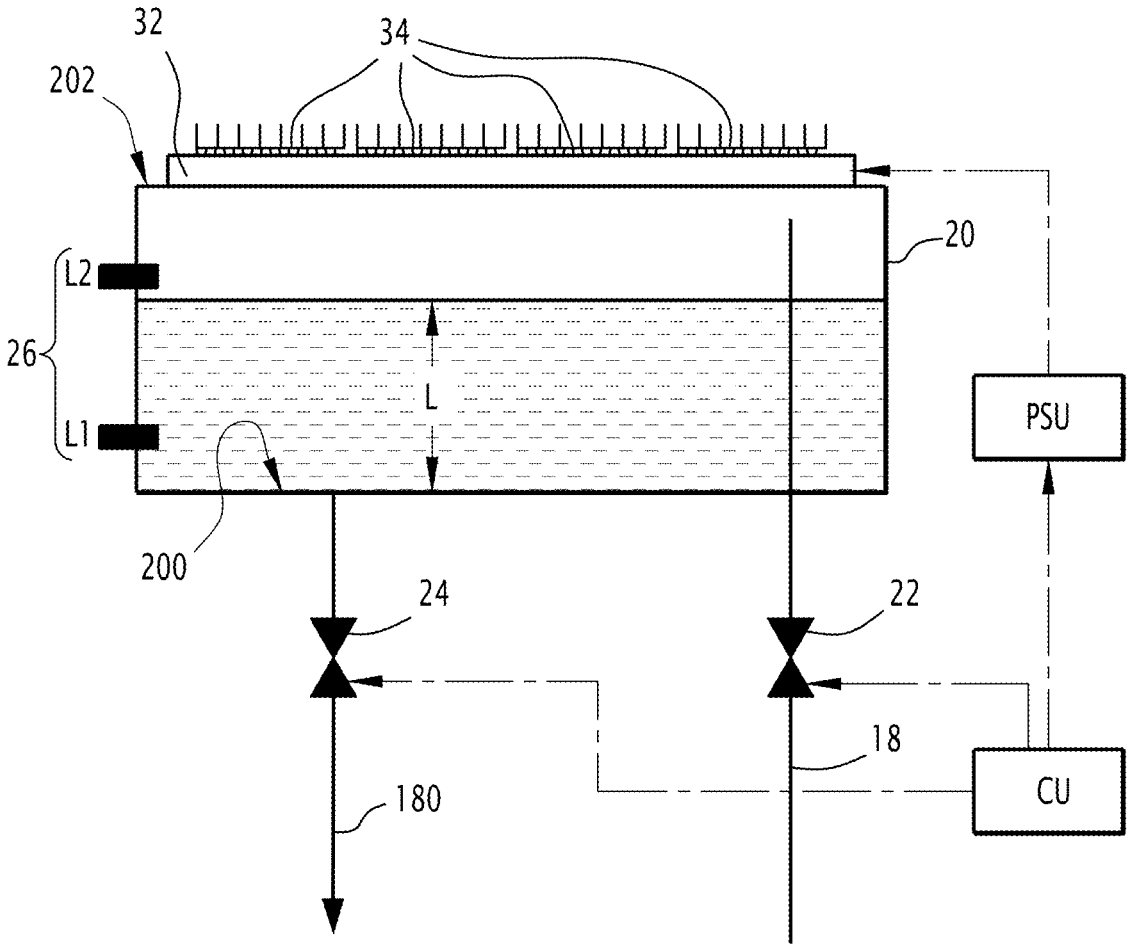
FIG. 2 is a synoptic drawing showing only a part of the refrigeration apparatus of FIG. 1 including a lubrication refrigerant tank.
Figure 3:
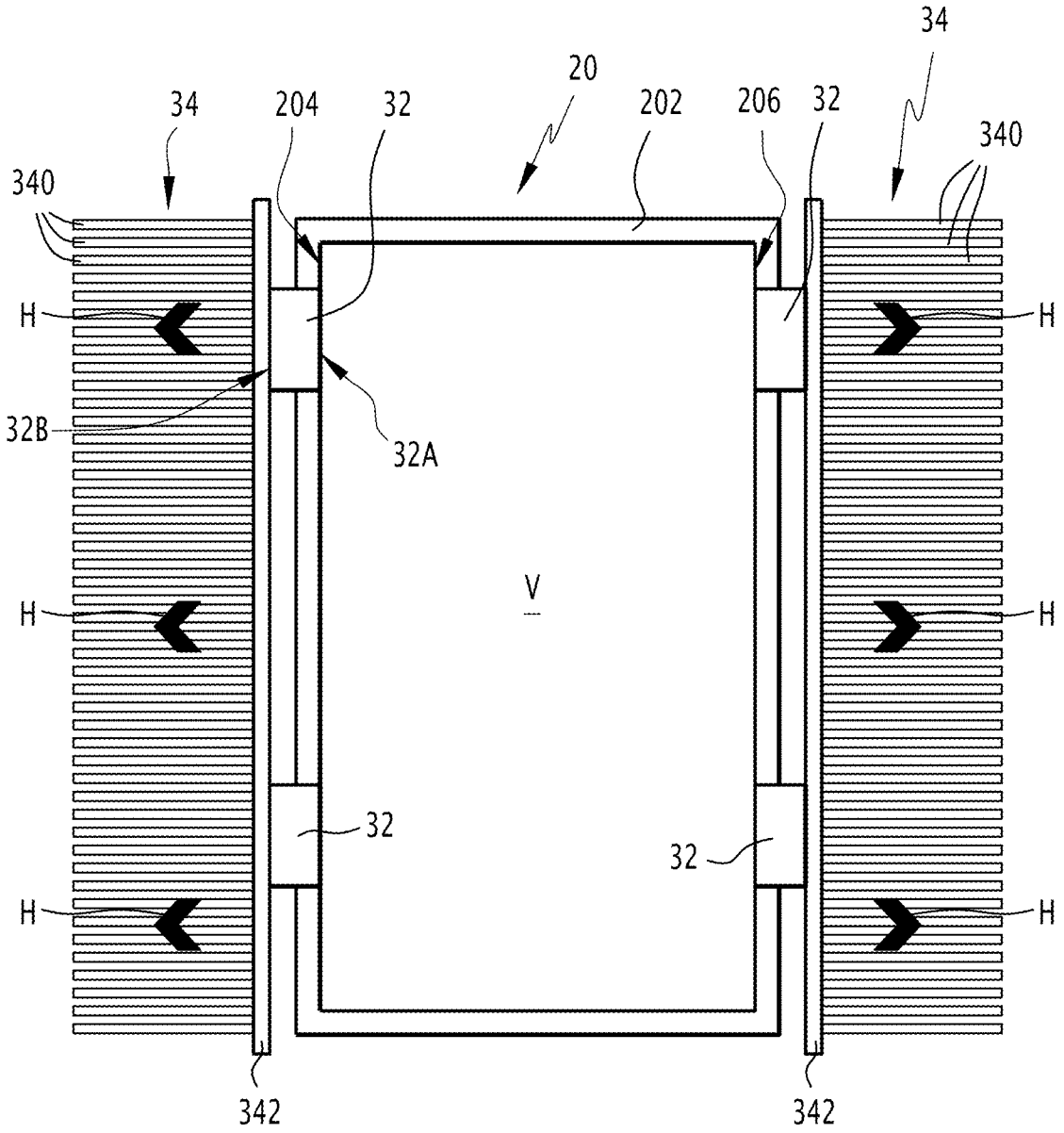
FIG. 3 is a synoptic drawing showing the lubricant refrigeration tank in transversal section.

As shown on FIGS. 1 to 3, the means to cool down the refrigerant stored in the lubrication refrigerant tank 20 are formed by at least one thermoelectric cooler 32 provided on a shell 202 of the lubrication refrigerant tank 20 configured to cool an inner volume V of the lubrication refrigerant tank 20. The means to cool down the refrigerant stored in the lubrication refrigerant tank 20 also comprises at least one heat sink 34 configured to reject a heat H generated by the thermoelectric cooler 32 outside the lubrication refrigerant tank 20. The thermoelectric cooler 32, also called "Peltier module" generates a temperature difference between two plates separated by a semiconductor medium in which circulates an electrical current. A first plate called "cold side" becomes colder and can cool down another element, while a second plate called "hot side" becomes hotter and can heat up another element. In the present case, the thermoelectric cooler 32 is mounted so that it cools down the shell 202, thereby cooling down the refrigerant contained in the lubrication refrigerant tank 20. This allows producing more liquid refrigerant suitable for lubrication of the compressor 4. At the same time the thermoelectric cooler 32 heats up the heat sink 34, which dissipates the heat H in the surrounding air. The thermoelectric cooler 32 is fed with electrical current just before or during a start or restart of the compressor 4.

As shown in more detail on FIG. 3, the lubrication refrigerant tank 20 may comprise a plurality of thermoelectric coolers 32 mounted in sandwich between at least one face 204 of the shell 202, and a heat sink 34 formed by heat dissipation fins 340 extending from a base plate 342. For example, the lubrication refrigerant tank 20 may comprise four thermoelectric coolers 32 mounted in pairs on two opposite faces 204 and 206 of the lubrication refrigerant tank 20. The lubrication refrigerant tank 20 may comprise two heat sinks 34 mounted on the thermoelectric coolers 32 so as to form two sandwich-like mounts on the face 204 and on the face 206. The thermoelectric coolers 32 have a cold side 32A attached to the face 204 or 206, and a hot side 32B attached to the base plates 342. The heat H generated by the hot sides 32B is conducted in the base plates 342 then dissipated in the fins 340. The fins 340 are preferably placed in a vented place so that the heat H is dissipated to the outside air.

As shown in FIG. 2, the refrigeration apparatus 1 may comprise an electrical power supply unit PSU configured to feed the at least one thermoelectric cooler 32 with electrical current on a starting operation of the refrigeration apparatus 1. The electrical power supply unit PSU may be controlled by the control unit CU. On starting operations, the control unit CU commands the power supply unit PSU to feed electrical current to the thermoelectric cooler 32. Once the starting operation is over, the thermoelectric cooler 32 is deactivated by commanding stoppage of the feeding with electrical current by the power supply unit PSU. The thermoelectric cooler 32 may be activated during limited durations, such as several seconds or minutes depending on the needs for lubrication refrigerant.

The thermoelectric coolers 32 may be provided in any number, disposition or position on the shell 202 of the lubrication refrigerant tank 20.

Figure 4:
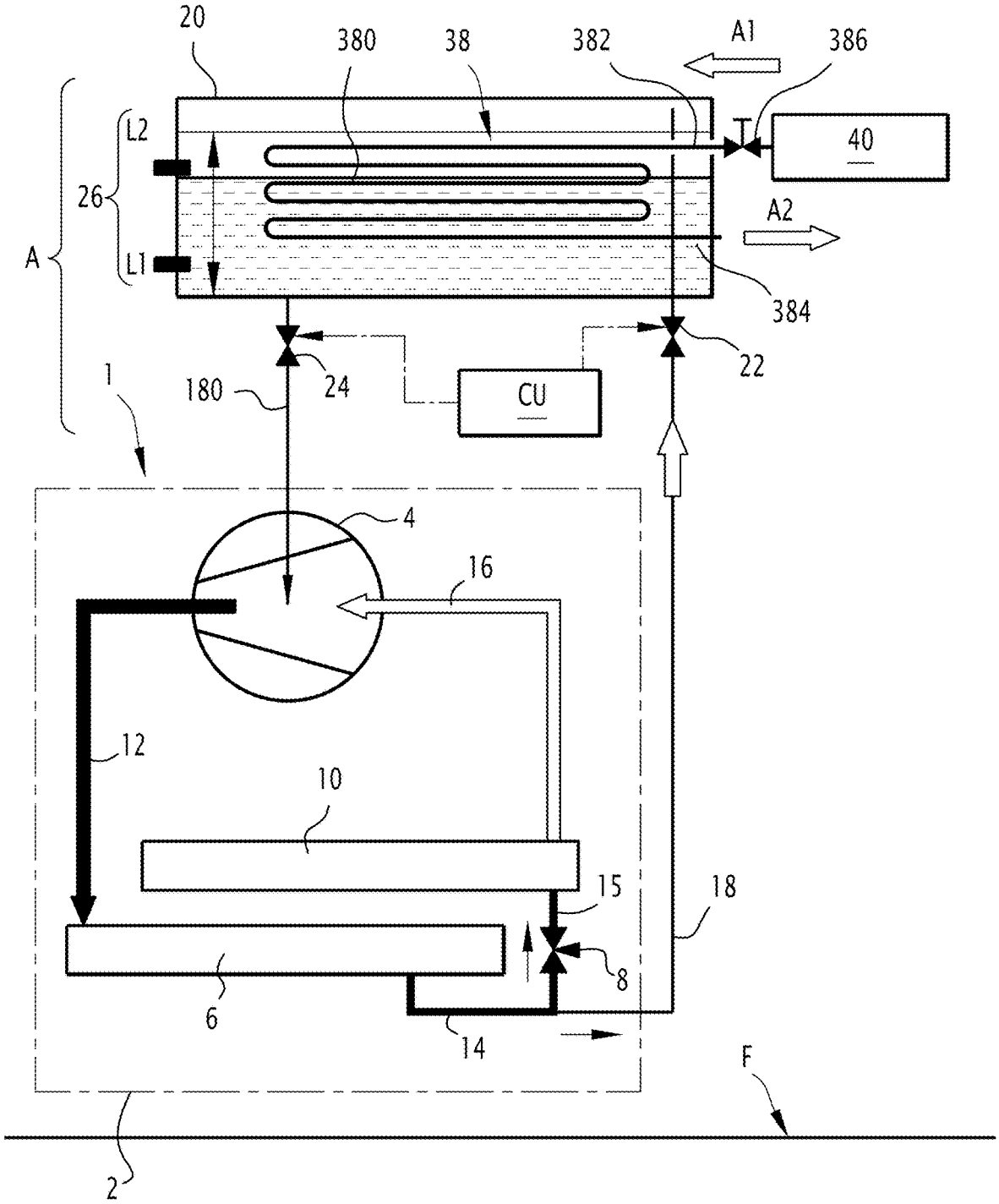
FIG. 4 is a synoptic drawing similar to FIG. 1, showing a refrigeration apparatus according to a second embodiment of the invention.

A second embodiment of the invention is shown in FIG. 4. In this embodiment, elements common to the embodiment of FIGS. 1 to 3 have the same references and work in the same way.

In this embodiment, the means to cool down the refrigerant stored in the lubrication refrigerant tank 20 comprise: a heat exchanger 38 comprising a tube 380 circulating within the lubrication refrigerant tank 20, the tube 380 having a first end 382 in which a pressurized gas is released along arrow A1, and a second end 384 connected to atmospheric pressure, and a removable container 40 of pressurized gas connected to the first end 382 of the tube 38, and configured to be opened toward the tube 380 so that the pressurized gas is released to the atmosphere as shown by arrow A2, along the tube 380 at a starting operation of the refrigeration apparatus 1.

The injection of the pressurized gas in the tube 380 induces expansion of the pressurized gas in the tube 380, thereby reducing the temperature of the gas and cooling down the refrigerant contained in the lubrication refrigerant tank 20 by heat exchange between the expanded gas and the refrigerant through the tube 380. This produces more liquid refrigerant in the lubrication refrigerant tank 20 and activates migration of liquid refrigerant towards the lubrication refrigerant tank 20. The release of the pressurized gas may be operated at a first start of the refrigeration apparatus 1. The removable container 40 is then disconnected from the first end 382.

The tube 380 may have a serpentine-like shape, configured to make maximal the heat exchange surface of the tube 380 in the lubrication refrigerant tank 20. The first end 382 of the tube 380 may comprise a valve 386 that is opened at a starting operation of the refrigeration apparatus 1.

The removable container 40 may contain a pressurized gas chosen amongst at least propane or carbon dioxide.

According to a non-shown embodiment of the invention, the means to cool down the refrigerant stored in the lubrication refrigerant tank 20 may comprise a magnetic cooling device or any other suitable device.

Other embodiments may be formed by combining the technical features of the embodiments and variants described here-above within the scope of the claims.

What is claimed:

1. A refrigeration apparatus comprising:

a main refrigerant circuit including a positive displacement compressor, a condenser, an expansion valve, and an evaporator, through which a refrigerant circulates successively in a closed loop circulation;

a lubrication refrigerant line connected to the main refrigerant circuit between the condenser and the expansion valve or to the condenser, in which circulates a portion of the refrigerant of the main refrigerant circuit and connected to the compressor for lubrication of said compressor with the refrigerant;

wherein the refrigeration apparatus comprises a lubrication refrigerant tank connected to the lubrication refrigerant line upstream the compressor, the lubrication refrigerant tank being configured to store liquid refrigerant for lubrication of the compressor;

and wherein the lubrication refrigerant tank comprises means to cool down the refrigerant stored in the lubrication refrigerant tank prior to a starting operation of the refrigeration apparatus;

a control unit configured to control the means to cool down the refrigerant stored in the lubrication refrigerant tank prior to a starting operation of the refrigeration apparatus.

2. The refrigeration apparatus according to claim 1, wherein the lubrication refrigerant tank is placed in a top area of the refrigeration apparatus, and feeds the compressor with lubrication refrigerant by gravity.

3. The refrigeration apparatus according to claim 1, wherein the lubrication refrigerant tank comprises detection means of the level of liquid refrigerant in the lubrication refrigerant tank.

4. The refrigeration apparatus according to claim 1, wherein the lubrication refrigerant line comprises a valve upstream the lubrication refrigerant tank and a valve downstream the lubrication refrigerant tank, and wherein these valves are closed during stand-by periods of the refrigeration apparatus and opened during a starting operation of the refrigeration apparatus.

5. The refrigeration apparatus according to claim 4, wherein the valves are solenoid valves that are controlled by the control unit of the refrigeration apparatus.

6. The refrigeration apparatus according to claim 1, wherein it comprises at least one heating device mounted on the condenser, or on the evaporator, or both, and configured to heat up the refrigerant contained in the condenser and/or the evaporator to induce migration of liquid refrigerant towards the lubrication refrigerant tank.

7. The refrigeration apparatus according to claim 6, wherein the heating device is an electrical heating belt.

8. A refrigeration apparatus comprising:

a main refrigerant circuit including a positive displacement compressor, a condenser, an expansion valve, and an evaporator, through which a refrigerant circulates successively in a closed loop circulation;

a lubrication refrigerant line connected to the main refrigerant circuit between the condenser and the expansion valve or to the condenser, in which circulates a portion of the refrigerant of the main refrigerant circuit and connected to the compressor for lubrication of said compressor with the refrigerant;

wherein the refrigeration apparatus comprises a lubrication refrigerant tank connected to the lubrication refrigerant line upstream the compressor, the lubrication refrigerant tank being configured to store liquid refrigerant for lubrication of the compressor;

and wherein the lubrication refrigerant tank comprises means to cool down the refrigerant stored in the lubrication refrigerant tank prior to a starting operation of the refrigeration apparatus;

wherein the means to cool down the refrigerant stored in the lubrication refrigerant tank are formed by at least one thermoelectric cooler provided on a shell of the lubrication refrigerant tank and configured to cool an inner volume of the lubrication refrigerant tank, and by at least one heat sink configured to reject heat generated by the thermoelectric cooler outside the lubrication refrigerant tank.

9. The refrigeration apparatus according to claim 8, wherein the lubrication refrigerant tank comprises a plurality of thermoelectric coolers mounted in sandwich between at least one face of the lubrication refrigerant tank and the heat sink.

10. The refrigeration apparatus according to claim 8, wherein the refrigeration apparatus comprises an electrical power supply unit configured to feed the at least one thermoelectric cooler with electrical current on a starting operation of the refrigeration apparatus.

11. A refrigeration apparatus comprising:

a main refrigerant circuit including a positive displacement compressor, a condenser, an expansion valve, and an evaporator, through which a refrigerant circulates successively in a closed loop circulation;

a lubrication refrigerant line connected to the main refrigerant circuit between the condenser and the expansion valve or to the condenser, in which circulates a portion of the refrigerant of the main refrigerant circuit and connected to the compressor for lubrication of said compressor with the refrigerant;

wherein the refrigeration apparatus comprises a lubrication refrigerant tank connected to the lubrication refrigerant line upstream the compressor, the lubrication refrigerant tank being configured to store liquid refrigerant for lubrication of the compressor;

and wherein the lubrication refrigerant tank comprises means to cool down the refrigerant stored in the lubrication refrigerant tank prior to a starting operation of the refrigeration apparatus;

further comprising at least one heating device mounted on the condenser, or on the evaporator, or both, and configured to heat up the refrigerant contained in the condenser and/or the evaporator to induce migration of liquid refrigerant towards the lubrication refrigerant tank, wherein the heating device is an electrical heating belt;

wherein the means to cool down the refrigerant stored in the lubrication refrigerant tank comprise:

a heat exchanger comprising a tube circulating within the lubrication refrigerant tank, the tube having a first end in which a pressurized gas is released, and a second end connected to atmospheric pressure;

a removable container of pressurized gas connected to the first end of the tube, and configured to be opened toward the tube so that the pressurized gas is released to the atmosphere along the tube at a starting operation of the refrigeration apparatus.

12. The refrigeration apparatus according to claim 11, wherein the tube has a serpentine-like shape.

13. The refrigeration apparatus according to claim 11, wherein the first end of the tube comprises a valve that is opened at a starting operation of the refrigeration apparatus.

14. The refrigeration apparatus according to claim 11, wherein the removable container contains a pressurized gas chosen amongst at least propane or carbon dioxide.

15. The refrigeration apparatus according to claim 1, wherein it operates an oil free refrigerant cycle.

16. A refrigeration apparatus comprising:

a main refrigerant circuit including a positive displacement compressor, a condenser, an expansion valve, and an evaporator, through which a refrigerant circulates successively in a closed loop circulation;

a lubrication refrigerant line connected to the main refrigerant circuit between the condenser and the expansion valve or to the condenser, in which circulates a portion of the refrigerant of the main refrigerant circuit and connected to the compressor for lubrication of said compressor with the refrigerant;

wherein the refrigeration apparatus comprises a lubrication refrigerant tank connected to the lubrication refrigerant line upstream the compressor, the lubrication refrigerant tank being configured to store liquid refrigerant for lubrication of the compressor;

and wherein the lubrication refrigerant tank comprises means to cool down the refrigerant stored in the lubrication refrigerant tank prior to a starting operation of the refrigeration apparatus wherein the means to cool down the refrigerant stored in the lubrication refrigerant tank comprise a magnetic cooling device.

* * * * *